US005347777A

United States Patent [19]

Sudduth

[11] Patent Number: 5,347,777

[45] Date of Patent: Sep. 20, 1994

[54] ANCHOR PLATE ASSEMBLY

[75] Inventor: James R. Sudduth, Seagoville, Tex.

[73] Assignee: Post Tension Product Mfg., Inc., Seagoville, Tex.

[21] Appl. No.: 52,487

[22] Filed: Apr. 23, 1993

[51] Int. Cl.[5] ..... E04C 5/12; E04C 3/26

[52] U.S. Cl. ..... 52/223.13

[58] Field of Search ..... 52/223.13

[56] References Cited

U.S. PATENT DOCUMENTS

| | | | |
|---|---|---|---|
| 3,108,404 | 10/1963 | Lamb | 52/704 |
| 3,289,379 | 12/1966 | Watts . | |
| 3,524,228 | 8/1970 | Kelly . | |
| 3,596,330 | 8/1971 | Scott et al. | 52/223.13 |
| 3,695,139 | 10/1972 | Howe | 52/707 |
| 3,762,027 | 10/1973 | Burtelson . | |
| 3,833,706 | 9/1974 | Edwards . | |
| 4,121,325 | 10/1978 | Bruinette et al. . | |
| 4,192,114 | 3/1980 | Jungwirth et al. . | |
| 4,343,122 | 8/1982 | Wlodkowski et al. . | |
| 4,363,462 | 12/1982 | Wlodkowski et al. . | |
| 4,561,226 | 12/1985 | Tourneur . | |
| 4,616,458 | 10/1986 | Davis et al. . | |
| 4,621,943 | 11/1986 | Swanson . | |
| 4,773,198 | 9/1988 | Reinhardt . | |
| 4,918,887 | 4/1990 | Davis et al. . | |
| 5,072,558 | 12/1991 | Sorkin et al. . | |
| 5,079,879 | 1/1992 | Rodriquez . | |

FOREIGN PATENT DOCUMENTS

| | | | |
|---|---|---|---|
| 2097443 | 11/1982 | United Kingdom | 52/223.13 |

*Primary Examiner*—James L. Ridgill, Jr.
*Attorney, Agent, or Firm*—Johnson & Wortley

[57] ABSTRACT

A post tensioning anchor plate assembly comprising an anchor plate and coupling elements therefor. The anchor plate is constructed with a pair of oppositely disposed, concentrically aligned cylindrical bosses, or mounting members, projecting from opposite sides of a generally rectangular plate. The oppositely disposed bosses define, on the inside surface thereof, a common tapered bore adapted for receiving a post tensioning cable therethrough and securement thereof for post tensioning of a concrete section. The outside surface of each boss is likewise constructed with a circumferential groove adapted for receiving an inwardly projecting lip of an appropriate plastic cap or tubular adapter secured thereover. In this manner, the plastic cap and tubular adapter can be mounted to opposite sides of the anchor plate in sealed engagement therewith for facilitating improved reliability of the post tensioning anchor plate assembly.

6 Claims, 1 Drawing Sheet

ANCHOR PLATE ASSEMBLY

BACKGROUND OF THE INVENTION

1. Field of the Invention

The present invention relates to post tensioning concrete anchor assemblies and, more particularly, to an anchor plate assembly for post tensioning structures.

2. History of the Prior Art

The technology for the post tensioning concrete structures is well established. Anchor plate assemblies are generally utilized for the securement of post tensioning filaments or tendons that extend through a body of concrete. The tendons, which are generally steel cables, impart compressive loads to, and enhance the strength of, the concrete in a manner that is sometimes not economically and/or mechanically possible with conventional rebar construction. Anchor assemblies on opposite end of the tendons are critical to this technique, and the effectiveness of the interconnection between the anchor plates and the tendons, as well as the sealing of the assembly, is critical to the effective life span of the construction.

Corrosion is an important consideration in the utilization of post tensioning assemblies. It is well known that corrosion can cause deterioration in the anchor plate assemblies and this can result in a deleterious effect on the ultimate strength of the concrete. It is for this reason that the steel fibers that generally comprise the post tensioning cables are usually placed within a plastic sheath which extends through the slab. This sheath must, however, be cut off short of its connection to the anchor assemblies in order to allow the anchor wedges thereof to directly engage the steel fibers. The exposed fibers must, however, be subsequently covered in some respect in order to prevent the problems of subsequent corrosion.

In order to facilitate sealing of post tensioning cables and the ultimate elimination of moisture therearound, grease is often used in or around the caps and tubular members that are generally used to cover the plate extending around the anchor plate. A thorough description of such prior art approaches, as well as related innovations in anchor plate assemblies and improvements therein, is set forth and shown in U.S. Pat. No. 4,821,474 which issued to Alan Rodriguez on Apr. 18, 1989. In this patent, an anchor plate assembly of a type utilized in post tensioning configurations is set forth and described in detail. Likewise other prior art patents also referenced in this particular patent include U.S. Pat. No. 4,363,462 to Wlodkowsi, et al., issuing on Dec. 14, 1982 and U.S. Pat. No. 4,121,325 to Bruinette, et al., issuing in 1978.

The above mentioned prior art references teach a variety of approaches to post tensioning anchor assemblies for prestressed concrete. As stated in certain ones of those references, the elimination of corrosion of the post tensioning cables and in the anchor plate assemblies is a primary consideration in order to prevent failure in the tensioning cable. The assembly of sealing caps and "stackable" tubular members on opposite sides of the anchor plate itself is well known in this particular technology. It would be an advantage however to provide an improved method of securing the cap and the tendon covering tubular members to the anchor plate for purposes of both shipping and handling of the anchor plate assembly as well as its subsequent use.

The present invention provides such an advance over the prior art by providing a post tensioning anchor plate assembly that utilizes aligned, cylindrical portions, or bosses, each being formed with a recess constructed in the outer cylindrical surfaces thereof. The recess or groove, is used to matingly engage protruding lips formed inside the plastic cap and inside the tubular connection member specifically adapted for connection to opposite sides of the anchor plate. In this manner, both the cap and the tubular connection member (or adapter) can be reliably secured to, and effectively sealed with, the anchor plate enhancing the reliability thereof. A compression ring is also provided for securement around the cap and tubular connection member to enhance the sealing thereof.

SUMMARY OF THE INVENTION

The present invention pertains to a post tensioning anchor plate assembly and its method of use. More particularly, one aspect of the invention includes an improved anchor plate assembly of the type wherein a generally rectangular plate having oppositely disposed, cylindrical mounting members, or bosses, is adapted for placement in a concrete formation for post tensioning thereof with a tendon, or cable, running therethrough. The improvement comprises the oppositely disposed bosses being concentrically aligned one with the other and each having at least one recess formed in the outer surface thereof adapted for a mating engagement of a generally cylindrical coupling element thereover for sealed engagement therewith. One of the coupling elements comprises a cap adapted for sealing an outer portion of the mounting plate. Another of the coupling elements includes a tubular mounting member adapted for sealed engagement with the boss extending into the concrete formation for receipt of the cable therein. The tubular mounting member includes an inwardly extending lip adapted for mating engagement with the recess of the boss.

In another aspect, the above described invention includes the cylindrical bosses each being formed with a circumferential groove substantially therearound adapted for receiving a generally circumferential lip projecting inwardly from the coupling elements. The oppositely disposed mounting members may also be connected by a single aperture formed therethrough in a tapered configuration therewith.

In yet another aspect, the invention includes a method of mounting a protective cap to a post tensioning mounting plate comprising the steps of forming said mounting plate with oppositely disposed bosses of generally cylindrical construction, forming a groove in the outer surface of the bosses, forming an inwardly projecting lip in the cap, and positioning the cap over the boss in mating engagement therewith.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
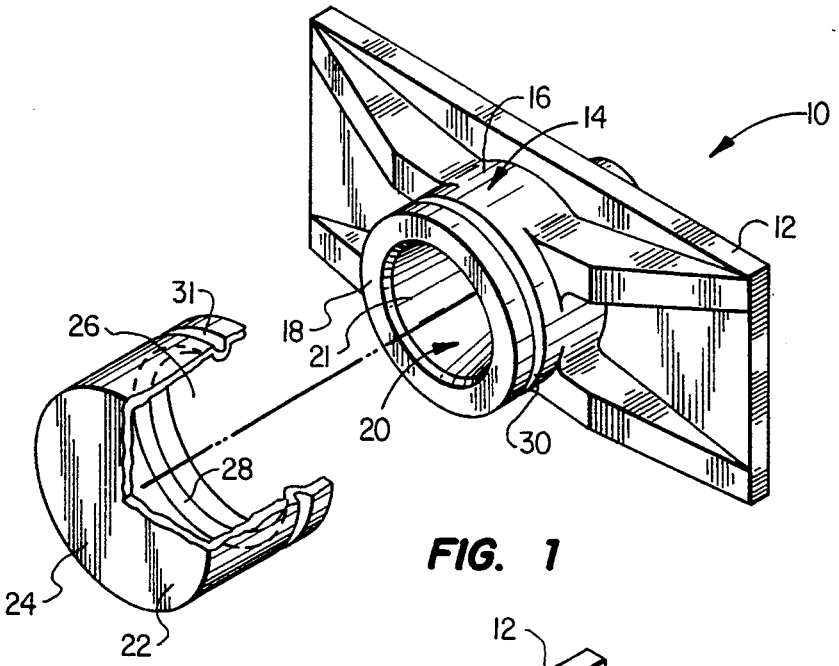
FIG. 1 is an exploded, perspective view of one embodiment of an anchor plate assembly constructed in accordance with the principles of the present invention.

Referring first to FIG. 1, there is shown an exploded perspective view of one embodiment of an anchor plate assembly 10 constructed in accordance with the principles of the present invention. In this view, there is presented the side of the assembly 10 which faces outwardly of a concrete structure. The outwardly facing assembly 10 includes a generally rectangular anchor plate 12 having a mounting boss 14 upstanding therefrom. The boss 14 includes a generally cylindrical outer surface 16 and a generally planar, end face 18. A central bore 20 having an outer end 21 is formed therethrough. The bore 20 is preferably tapered for receipt of anchoring wedges which will be described in more detail below.

Still referring to FIG. 1, a cap 22 having a generally planar outer end 24 is constructed for mounting to, and sealing with, the cylindrical surface 16 of boss 14. The cap 22, as shown herein, has a portion 26 cut away for purposes of illustrating a lip 28 formed therein. The lip 28 is adapted to engage a groove 30 formed in the surface 16 of the boss 14 of the anchor plate 12 upon installation thereover. A groove 31 is also formed around the outer portion of cap 22 in the region of lip 28 to therein provide means for receiving a ring, or the like, therein for exerting an inwardly directed pressure upon the lip 28 as it engages groove 30 to enhance the sealing thereof. This aspect will be described in more detail below.

Figure 2:
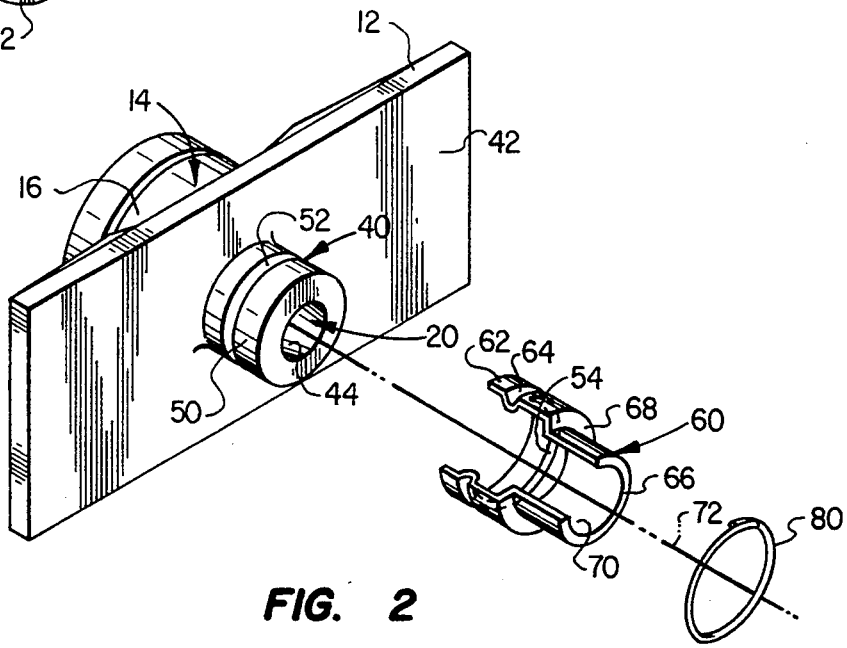
FIG. 2 is an exploded, perspective view of the anchor plate assembly of FIG. 1 taken from the opposite side thereof.

Referring now to FIG. 2, there is shown an exploded, perspective view of the inwardly facing portion of the anchor plate assembly of FIG. 1. This view is taken from the side of plate 12 facing inwardly toward a concrete structure. The anchor plate 12 is shown to be constructed with oppositely disposed, concentrically aligned bosses 14 and 40. Boss 40 extends from a substantially planar side 42 of anchor plate 12. From the boss 40, opening 44 of aperture 20 can be seen, which opening 44 is of smaller diameter than the end 21 shown in FIG. 1. The boss 40 has an outer surface 50 of generally cylindrical, but smaller diameter construction compared to the surface 16 of boss 14. The boss 40 is adapted to engage a tubular member (shown in FIG. 3) or tubular member adapter 60 adapted for assembly thereto in sealed engagement therewith. In that regard, a groove 52 is formed in the surface 50 which groove 52 is adapted to engage a lip 54 formed within the adapter 60. The adapter 60 and the cap 22 (shown in FIG. 1 ) may be made of plastic such as polyethylene, or the like, which material provides sufficient flexibility and resilience for expanding over the respective boss mounting surfaces. This expansion allows the lips 28 and 54 to contract over and engage the respective grooves therein for sealed engagement therewith.

Still referring to FIG. 2, the adapter 60 is constructed with a first cylindrical body portion 62 in which inwardly directed lip 54 is formed. Outwardly of lip 54 a groove 64 is located to therein provide means for receiving a ring or other securement member therearound to apply pressure to the lip 54 while it is in engagement with groove 52 of boss 40. Extending rearwardly from cylindrical portion 62 is extension section 66 concentrically formed therewith and having a smaller diameter relative thereto. A transition, or shoulder region 68 is shown to connect first portion 62 with second section 66. The section 66 is formed with a central aperture 70 that is sized to permit receipt of a cable therein and extension therethrough into the aperture 20 of anchor plate 12. A center line 72 is representatively shown to illustrate both the exploded view of the tubular member adapter 60 and the center thereof wherein a cable would lie therethrough. Such a cable is shown in FIG. 3.

Referring still to FIG. 2, a coil ring 80 is representatively shown to illustrate the placement thereof in the groove 64 of the body portion 62 of tubular member adapter 60. Ring 80 is but one embodiment of the type of structure which could be utilized to apply compressive pressure to the lip 54 during its engagement with groove 52. A similar ring structure would be provided in groove 31 of cap 22, as shown in FIG. 1.

Figure 3:
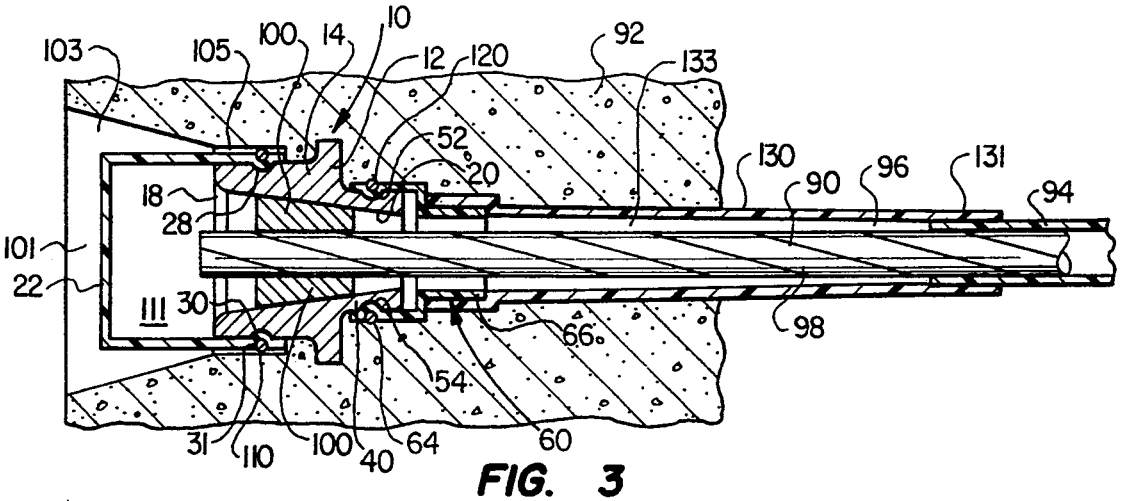
FIG. 3 is a side elevational, cross sectional view of the anchor plate assembly of FIG. 1 taken along lines 3—3 thereof and illustrating the assembled configuration including a cable and a tubular member covering the cable within a concrete structure.

Referring now to FIG. 3, there is shown a side elevational, cross sectional view of an assembled anchor plate assembly 10 of the type shown in FIG. 1. A tendon 90 is shown extending therefrom within a concrete structure 92. The tendon, or cable 90, shown in FIG. 3 is also constructed with a protective sheath 94 which has been cut away in the region 96 to expose the steel fibers 98 thereof in the vicinity of the anchor plate 12. The fibers 98 are exposed to allow placement of securement wedges 100 within the tapered bore 20 of anchor plate 12. The wedges 100 secure cable 90 relative to both the anchor plate and the concrete structure 92. The wedges 100 are each tapered, as is the bore 20 of the anchor plate 12, for securing said cable against movement after post tensioning. In this embodiment, the raw strands 98 of cable 90 are shown to be in direct engagement with the anchoring wedges 100, as is conventional in such construction.

Still referring to FIG. 3, the anchor plate 12 is secured in the concrete structure 92 as a result of a pour of concrete therearound. A cavity 101 is shown formed around the end 18 of anchor pl ate 12. This step is conventional in the prior art. The cavity 101 is typically formed by a "pocket former" (not shown), which cavity permits access to the anchor plate 12 to permit the tensioning of the cable 90 and the placement of the wedges 100 there against. Referring still to FIG. 3, the cavity 101 comprises a first tapered region 103 formed adjacent an inner cylindrical region 105. The cylindrical region 105 exposes the portion of the boss 14 having the groove 30 formed therein. In this manner, a cap 22 may be received thereover, and the lip 28 of cap 22 matingly engages the groove 30 of boss 14 as herein shown. A compression ring 110, as described above, is shown placed within the outer groove 31 of cap 22 to therein apply inward pressure from lip 28 against the groove 30 of boss 14. This configuration facilitates the sealing of the assembly to inhibit moisture infiltration. A cavity 111 is formed within the cap 22. The cavity 111 may be filled with grease in accordance with prior art techniques. The grease has been used to reduce the area which moisture can accumulate and to further facilitate the sealing thereof to prevent moisture infiltration therethrough.

Still referring to FIG. 3, the tubular adapter 60 is likewise shown secured to the inside of anchor plate 12 which is rigidly secured within the concrete structure 92. A compression ring 120 is shown disposed within the groove 64 of tubular adapter member 60. This assembly permits the generation of inward pressure through lip 54 against the groove 52 of boss 40 as described above. A conventional tubular extension member 130 is shown mating with the tubular adapter member 60 in the region of cylindrical section 66. The tubular member 130 is disposed in a press fitting engagement with the section 66 of tubular adapter member 60 to provide a sealed engagement there-between. It may likewise be seen that the distal end 131 of tubular member 130 is shown to tightly engage the sheath 94 of cable 90 to also provide a sealed engagement therewith. In this manner, a sealed cavity 133 is formed around cable 90, which cavity can be filled with grease or the like in accordance with conventional post tensioning technology. It may be seen that the cavity 133 extends within the tubular adapter member 60 and through the boss 40 thereof to terminate, in this particular view, against the wedges 100 disposed therein. It should be noted that the wedges 100 are typically tapered metal members, and spaces may exist therebetween, in which instance, cavity 133 would merge into cavity 111, which may also be filled with grease.

The actual utilization of grease and/or other compounds in the sealing of the cap and tubular members of the present invention is conventional in this technology. Likewise, utilization of tubular member 130 is conventional in the art, as is the use of a sheathed cable 90. The present invention thus pertains specifically to means for improving the assembly of a cap outwardly of an anchor plate as well as the use of a tubular adapter member 60 inwardly of the anchor plate 12 for sealed engagement around cable 90. As stated above, any variety of rings 80 (as shown in FIG. 2) and 110 and 120 (as shown in FIG. 3), is possible. The rings 80, 110, and 120 may be snap rings, steel spring sections, elastic members such as O-rings, and related structures. The present invention provides a method of and apparatus for improving the sealed configuration between such elements as cap 22 and tubular extension member 60 and the respective mounting bosses.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A method of mounting a tubular adaptor to a post tensioning mounting plate of the type used for anchoring a post tensioning tendon to a concrete formation, comprising the steps of:

forming said mounting plate with a mounting member of generally cylindrical construction disposed on the side of the mounting plate facing the concrete formation;

forming a groove in the outer surface of said mounting member;

forming an inwardly projecting lip within said tubular adaptor;

forming a groove in the outer surface of said tubular adaptor;

mounting said tubular adaptor over said mounting member with said inwardly projecting lip of said tubular adaptor engaging said groove in said mounting member; and providing a compression ring and receiving said compression ring in said groove of said tubular adaptor.

2. A method of mounting a coupling element cap to a post tensioning mounting plate of the type used for anchoring a post tensioning tendon to a concrete formation, comprising the steps of:

forming said mounting plate with a mounting member of generally cylindrical construction disposed on the side of the mounting plate facing away from the concrete formation;

forming a groove in the outer surface of said mounting member;

forming an inwardly projecting lip within said cap;

forming a groove in the outer surface of said cap;

mounting said cap over said mounting member with said inwardly projecting lip of said cap engaging said groove in said mounting member; and providing a compression ring and receiving said compression ring in said groove of said cap.

3. An improved anchor plate assembly of the type in which a plate for placement in a concrete formation includes an aperture for a tendon to pass therethrough, a first side facing away from the concrete formation, and a second side facing the concrete formation, the improvement comprising:

a mounting member mounted to the first side of the plate, said mounting member having an aperture sized for the passing of the tendon therethrough and aligned with the aperture in the plate, an outer surface extending from the plate, and a continuous groove in the outer surface which surrounds said mounting member;

a cap having an open end with an interior for receiving the outer surface of said mounting member and a lip for engaging the groove of said mounting member, and with an exterior having a groove located sufficiently close to the lip of the interior region that force applied to the groove will cause pressure between the lip of the interior region and the groove of said mounting member, and having a closed end; and a ring for mounting within the groove of said cap and applying force thereon, thereby causing pressure between the lip of said cap and the groove of said mounting member.

4. An improved anchor plate assembly of the type in which a plate for placement in a concrete formation includes an aperture for a tendon to pass therethrough, a first side facing away from the concrete formation, and a second side facing the concrete formation, the improvement comprising:

a mounting member mounted to the second side of the plate, said mounting member having an aperture sized for the passing of the tendon therethrough and aligned with the aperture in the plate, an outer surface extending from the plate, and a continuous groove in the outer surface which surrounds said mounting member;

a tubular adaptor having a first end with an interior for receiving the outer surface of said mounting member and a lip for engaging the groove of said mounting member, and with an exterior having a groove located sufficiently close to the lip of the interior region so that force applied to the groove will cause pressure between the lip of the interior region and the groove of said mounting member, and having a second end with an interior region for passing the tendon therethrough; and a ring for mounting within the groove of said tubular adaptor and applying force thereon, thereby causing pressure between the lip of said tubular adaptor and the groove of said mounting member.

5. The improved anchor plate assembly as in claim 4, wherein the improvement further comprises a tubular member having a central passage for passage of the tendon and having a first end with an interior surface adapted for press fit on the exterior surface of the second end of said tubular adaptor.

6. The improved anchor plate assembly as in claim 4, wherein the improvement further comprises a tubular member having a central passage for passage of the tendon, a first end with an interior surface adapted for press fit on the exterior surface of the second end of said tubular adaptor, and a second end with an interior surface adapted for mating engagement with said tendon.

* * * * *

UNITED STATES PATENT AND TRADEMARK OFFICE

CERTIFICATE OF CORRECTION

PATENT NO. : 5,347,777

DATED : September 20, 1994

INVENTOR(S) : James R. Sudduth

It is certified that error appears in the above-indentified patent and that said Letters Patent is hereby corrected as shown below:

Column 4, line 39: Delete "pl ate"; insert --plate--

Signed and Sealed this

Fourteenth Day of March, 1995

*Attest:*

*Attesting Officer*

BRUCE LEHMAN

*Commissioner of Patents and Trademarks*